United States Patent [19]

Yoshino et al.

[11] Patent Number: 4,895,104

[45] Date of Patent: Jan. 23, 1990

[54] DEVELOPER RESERVOIR

[75] Inventors: Masahiro Yoshino; Keisuke Yamaguchi; Yoshinaga Mitsuhashi; Susumu Owada, all of Hachioji, Japan

[73] Assignee: Konica Corporation, Tokyo, Japan

[21] Appl. No.: 214,671

[22] Filed: Jul. 1, 1988

[30] Foreign Application Priority Data

Jul. 13, 1987 [JP] Japan ..... 62-175383

[51] Int. Cl.[4] ..... G03G 15/08

[52] U.S. Cl. ..... 118/653; 220/258; 222/DIG. 1; 355/260

[58] Field of Search ..... 222/DIG. 1, 541; 206/602, 633, 216, 631; 355/3 DD; 220/346, 345, 258, 260, 270; 118/653

[56] References Cited

U.S. PATENT DOCUMENTS

| | | | |
|---|---|---|---|
| 3,356,248 | 12/1967 | Del Vecchio | 220/345 |
| 3,999,654 | 12/1976 | Pollack | 206/633 X |
| 4,251,001 | 2/1981 | Hipp, Jr. | 206/216 X |
| 4,650,070 | 3/1987 | Oka et al. | 206/216 |
| 4,778,086 | 10/1988 | Shibata et al. | 222/DIG. 1 X |
| 4,799,608 | 1/1989 | Oka | 222/DIG. 1 X |

FOREIGN PATENT DOCUMENTS

| | | | |
|---|---|---|---|
| 0115968 | 6/1985 | Japan | 355/3 DD |

*Primary Examiner*—A. T. Grimley
*Assistant Examiner*—Robert Beatty
*Attorney, Agent, or Firm*—Jordan B. Bierman

[57] ABSTRACT

A developer reservoir in which a flexible seal member is separably bonded to the circumferential surface of an opening in a bottom portion of a reservoir body containing a developer for sealing the same opening. A portion extended from the bonded flexible seal member is spot-bonded on a plurality of portions of the bottom portion of the reservoir body so that when a considerably large pulling out force is applied to the seal member the seal member is separated first from the spot-bonded portions of the bottom portion of the reservoir body and then from the circumferential surface of the opening of the reservoir body. A sliding cover is also included below the seal member so that the sliding cover can be drawn in a right angle direction to the separating direction of the seal member.

5 Claims, 6 Drawing Sheets

DEVELOPER RESERVOIR

BACKGROUND OF THE INVENTION

1. Field of the Invention

This invention relates to an improvement in a developer reservoir joined to a developing device in an electrophotographic reproducing machine or an electrostatic recording apparatus, such as a laser printer and used to supplementarily supply a developer to the developing device.

2. Description of the Prior Art

In general, in an electrostatic recording apparatus, an electrostatic latent image on a turning image retainer is developed by a developing device, and a powdered toner in a developer is applied to the electrostatic latent image to develop the latent image into a toner image, which is then transferred and fixed to recording paper. Since the powdered toner is consumed as the development of the latent image progresses, it is necessary that the toner be supplementarily supplied to the developing device correspondingly to the consumption thereof. A developer make-up unit (developer hopper) is provided as a storage unit for the toner to be supplementarily supplied.

A large quantity of toner is contained in the developer make-up unit, and, before this toner has been completely consumed, toner is supplementarily supplied from a toner tank (developer reservoir) to the developer hopper.

The above is a description of a toner resupplying operation in an electrostatic recording apparatus using a dry two-component developer. The same developer resupplying operation is also required in an electrostatic recording apparatus using a one-component developer.

In both the case where a two-component developer is used and the case where a one-component developer is used, a developer resupplying operation is generally carried out by introducing a developer from the developer reservoir into the developer hopper.

The powdered developer is liable to fly off. During the developer resupplying operation, the developer flies off and floats, or flows and scatters from the openings of the developer reservoir and hopper to the outside to cause the outside air and the operator's clothes to be contaminated. Many means for preventing this inconvenience have been proposed.

These proposed means include a developer reservoir disclosed in Japanese Utility Model Laid Open No. 114572/1984. In this developer reservoir, a developer is held in a box type reservoir body, and a bottom opening of this reservoir body is sealed with a flexible film, one end of which is fixed to a movable cover. In order to resupply the developer, the movable cover is opened, so that the film is drawn to cause the bottom opening of the reservoir body being opened gradually, whereby the developer in the reservoir body falls from the opening into a hopper.

The developer placed in the hopper is supplementarily supplied at a suitable and constant rate from a supply port at a lower portion of the hopper to the interior of the developing device. In order to carry out the resupplying of the developer properly, this supply port is set to a length substantially equal to the total length of a developing sleeve and a photosensitive drum in the developing device.

Such a developer reservoir is joined to the front side of the developing device, and the developer falling from the developer reservoir has to be sent from the front side of the hopper thereinto by a rotary screw. This necessarily causes not only the construction of the interior of the hopper but also the construction of a means for placing the developer to a uniform height in the hopper to become complicated.

Especially, in a multicolor copier, in which a developing device is provided detachably so that the developing device can be replaced by a developing device containing a different developer, i.e. a different color toner, a power transmission means for connecting a rotary screw in a hopper and a driving power source in a copier body becomes complicated. It is demanded that, during a developer resupplying operation, the developer falls uniformly from a developer reservoir into a hopper, accordingly.

SUMMARY OF THE INVENTION

An object of the present invention is to provide an improved developer reservoir capable of preventing the contamination occurring in the above-described conventional developer reservoir, dropping a developer into a hopper during a developer resupplying operation so that the developer is distributed uniformly in the hopper, and being constructed simply and operated excellently.

A developer reservoir according to the present invention, which is capable of achieving this object, is characterized by comprising a reservoir body containing a developer therein, a flexible seal member separably bonded to the circumferential surface of an opening in a bottom portion of the reservoir body for sealing the same opening, and a sliding cover provided at a position below the seal member slidably with the reservoir body and having a stopper member for preventing the separation of the seal member.

The developer reservoir according to the present invention is further characterized in that when the sliding cover is drawn in the direction which is at right angles to the seal member separating direction, the stopper member is displaced backward to enable the seal member to be separated, and when the seal member is then drawn out from a slit in the reservoir body, the opening in the bottom portion of the reservoir body is opened to permit the developer in the reservoir body to be discharged.

The other objects and characteristics of the present invention will become apparent from the following description of the preferred embodiment taken in conjunction with the drawings.

DESCRIPTION OF THE PREFERRED EMBODIMENT

A developer reservoir consists mainly of a cross-sectionally rectangular reservoir body 1 containing a developer D therein, a flexible seal member 2 adapted to seal an opening in a bottom portion of the reservoir body 1, and a sliding cover 3 provided at a position below the seal member 2 slidably with the reservoir body 1.

The reservoir body 1 is a box type integrally molded part having an opening in a bottom portion thereof. A laterally elongated flat hexagonal sealing surface 1A is formed on the inner circumference of the opening. The flexible sealing member 2 is thermally fused to the sealing surface 1A so that the seal member 2 can be separated therefrom.

On the left side of the sealing surface 1A, three small projections 1C are formed on the surface of a wall 1B so that the free ends of the projections 1C are substantially flush with the sealing surface 1A. The flexible seal member 2 is thermally fused to the small projections 1C so that the flexible seal member 2 can be separated therefrom.

On the left side of this wall 1C, a recess 1D is formed, in which a loop portion of the flexible seal member 2 is inserted and folded back. One side portion of this recess 1D is opened at a small opening 1E, through which a flat portion 3A, which will be described later, is passed.

Two small projections 1F extend slightly from an upper wall of the recess 1D. A part of the outer circumferential surface of the flexible seal member 2 inserted in a looped state in the recess 1D is engaged with and thermally fused to these small projections 1F.

Substantially flat flanges 1G are formed at both sides of the reservoir body 1 which are slightly higher than the bottom portion thereof, and slide rails 1H, 1J are provided in parallel with each other on the lower surfaces of the flanges 1G which are close to the left and right ends, respectively, thereof. The slide rails 1H, 1J extend at right angles to a removing direction of the seal member 2, and slide rails 3B, 3C of the sliding cover 3 are engaged slidably with these slide rails 1H, 1J. The slide rails 1H, 1J are provided with click grooves 1K, 1L which are adapted to engage and disengage from click projections 3D, 3E provided on the sliding cover 3.

Figure 1:
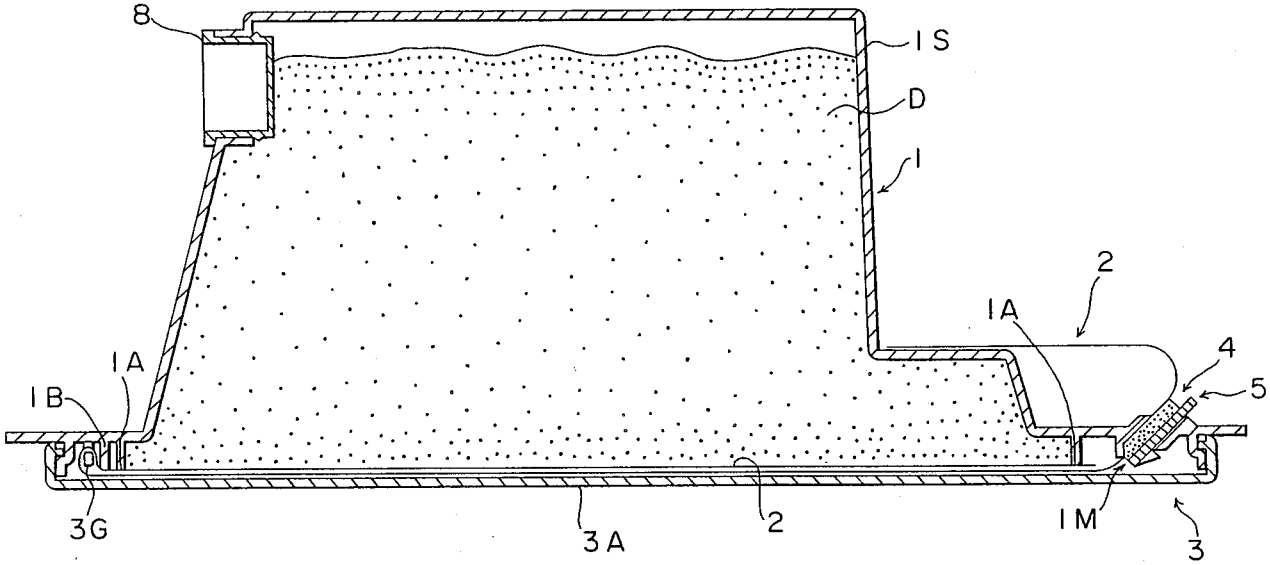
FIG. 1 is a sectional front elevation of a developer reservoir according to the present invention.

The flange 1G provided at the right side of the reservoir body 1 has a slit 1M having inclined surfaces of an angle of inclination of about 45°. In this slit 1M, a cleaning pad 4 and a retainer member 5, which will be described later, are inserted from the lower side and fixed as shown in FIG. 1.

Figure 3:
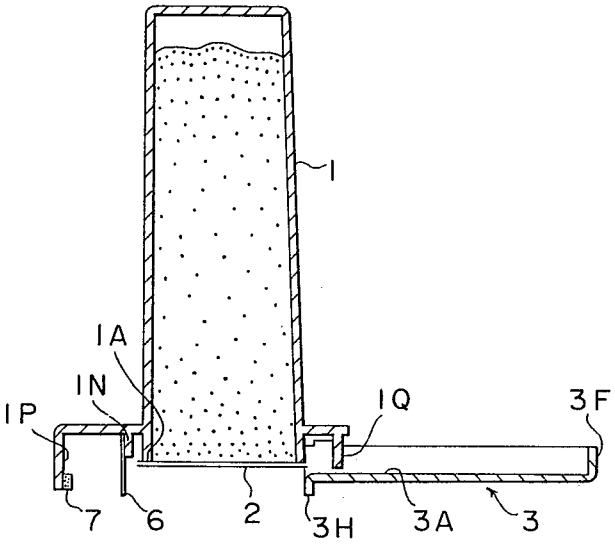
FIGS. 2 and 3 are sectioned side elevations of the developer reservoir.
Figure 2:
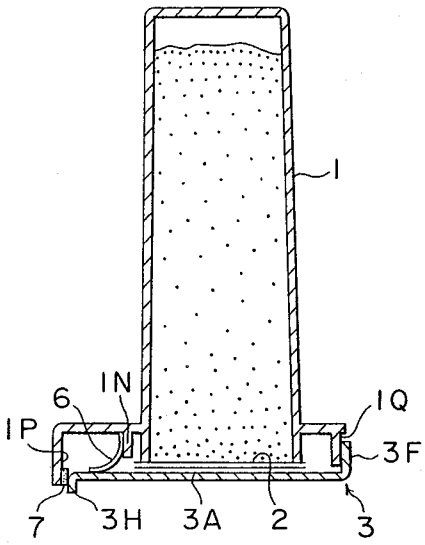
Figure 5:
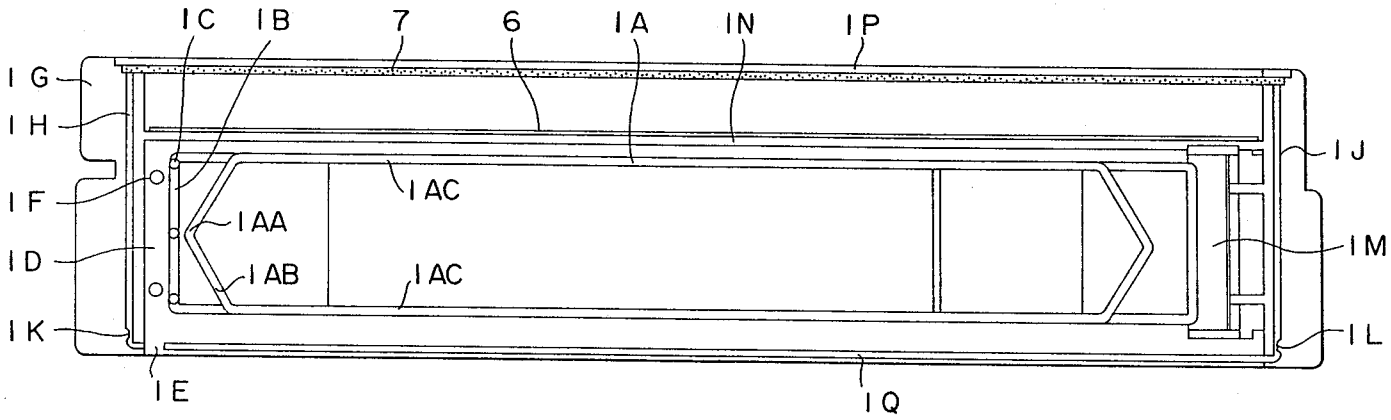
FIG. 5 is a bottom view of the reservoir body.

As shown in the sectioned side elevations of FIGS. 2 and 3 and the bottom plan of FIG. 5, a wall 1N is formed in parallel with a longer side wall 1P of the sealing surface 1A of the reservoir body 1. An elastic member (scraper) 6 is bonded to one side surface of the wall 1N by using a double-side tape etc. The lower end portion of this elastic member 6 engages the inner surface of a flat portion 3A of the sliding cover 3 slidably in a bent state when the sliding cover 3 is closed.

An elastic member (packing) 7 is pasted on the inner surface of the longer side wall 1P at a position lower than the flanges 1G of the reservoir body 1. For example, a sponge type foamed elastic material, a hair-implanted material or a felt type fiber cloth is used for this elastic member 7. When the sliding cover 3 is closed, the elastic member 7 is held under pressure between the side wall 1P of the reservoir body 1 and one end of the sliding cover 3 to thereby prevent the developer floating in the reservoir body 1 from leaking to the outside after a developer resupplying operation has been carried out.

The outer surface of a side wall 1Q, which is on the opposite side of the side wall 1P, serves as a stopper surface as well as a closing surface which engages the inner surface of a wall 3F of the sliding cover 3 when the sliding cover 3 is closed.

Figure 4:
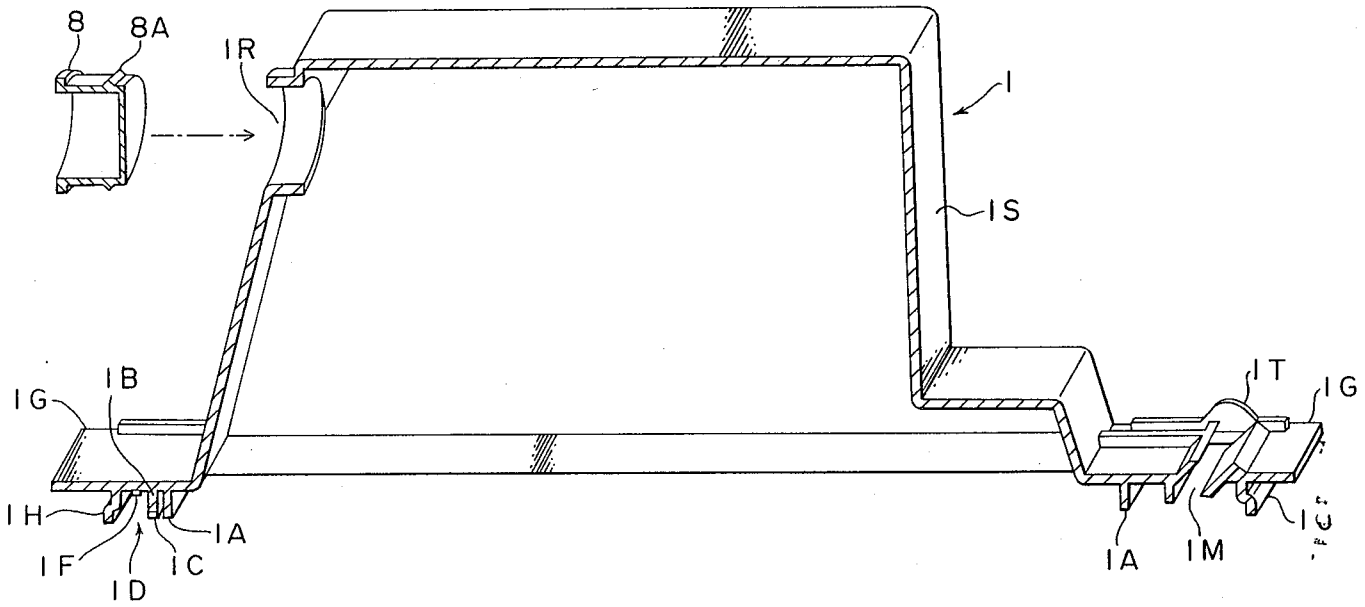
FIG. 4 is a sectioned front elevation of a reservoir body.

The reservoir body 1 shown in FIGS. 1 and 4 is provided at the upper portion of the left side wall thereof with an opening 1R, which is adapted to be sealed under pressure with a cap member 8.

The cap member 8 is inserted forcibly into the opening 1R by using a pressure device, to seal the same after a developer has been placed in the reservoir body 1 with the opening at the bottom portion thereof sealed with the flexible seal member 2. A right side wall 1S, which is opposed to the opening 1R, of the reservoir body 1 is a flat wall supporting the reservoir body 1 when the cap member 8 is inserted under pressure into the opening 1R.

The material of the molded reservoir body 1 is a resin, such as high impact polystyrol or polypropylene, and the molding method is the hot forming, such as the injection molding.

Figure 6:
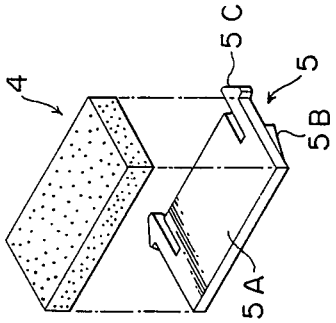
FIG. 6 is an exploded perspective view of a cleaning pad and a retainer member.

FIG. 6 is an exploded perspective view of the cleaning pad 4 and retainer member 5. The cleaning pad 4 is made of a sponge type foamed elastic material, and the retainer member 5 is bonded thereto with a double side tape. The retainer member 5 has a flat portion 5A on which the cleaning pad 4 is bonded, a stopper portion 5B on the lower surface thereof, and claw portions 5C at free end sections of left and right cuts thereof.

When the retainer member 5 combined unitarily with the cleaning pad 4 is inserted forcibly into the slit 1M in the reservoir body 1 from the lower side thereof as shown in FIG. 1, the stopper portion 5B stops at the lower end portion of the slit 1M, and the claw portions 5C engage mountain-shaped locking portions 1T in the vicinity of upper portions of the slit 1M, so that the retainer member 5 is fixed in a non-backwardly-drawable state.

Figure 7:
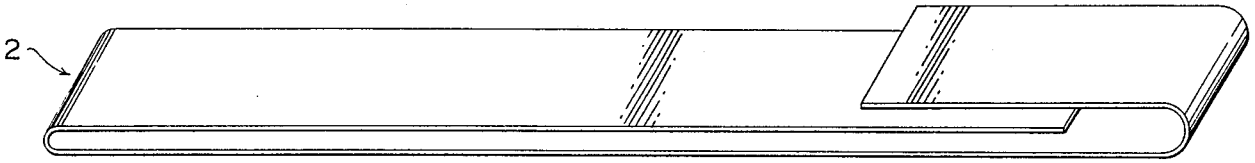
FIG. 7 is a perspective view of a seal member.

FIG. 7 is a perspective view of the flexible seal member 2. The materials used to manufacture the seal member 2 include a plastic film material, such as polyethylene, polyethylene terephthalate, polypropylene, polyvinyl chloride, polyvinylidene chloride, polycarbonate and nylon, and a metal material, such as aluminum foil. A monolayer or a laminate of these materials is used in practice. It is necessary that the flexible seal member 2 consists of a material having suitable flexibility, tensile strength, bending strength and thickness. A 75 μm thick film obtained by laminating a 50 μm thick polyethylene film on a 25 μm thick polyethylene terephthalate (PET) film was used as an example of the seal member 2.

Figure 8:
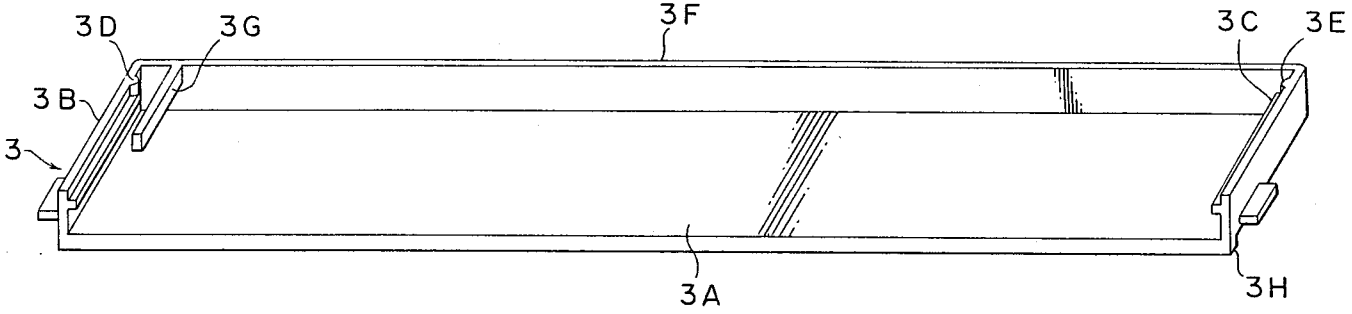
FIG. 8 is a perspective view of a sliding cover.

FIG. 8 is a perspective view of the sliding cover 3. The sliding cover 3 is made like a rectangular box, and the left and right shorter side sections of the flat portion 3A constitute slide rails 3B, 3C. The slide rails 3B, 3C are provided at portions thereof which are in the vicinity of the terminal ends thereof with projections 3D, 3E, which are engaged with the click grooves 1K, 1L in the reservoir body 1 when the sliding cover 3 is closed with respect to the reservoir body, whereby the sliding cover cannot be carelessly opened.

The flat portion 3A of the sliding cover 3 serves as a barrier for protecting the flexible seal member 2, which is fused to the bottom opening of the reservoir body 1, against an external force, and backs up the flexible seal member 2 so as to prevent the fused seal member 2 from being separated due to the weight of the developer D in the reservoir body 1 or an impact force.

A vertical surface 3F at the rear portion of the sliding cover 3 constitutes a stopper surface as well as a closing surface, which is engageable with the side wall 1Q of the reservoir body 1, as previously mentioned. A stopper member 3G is formed integrally with and projects from one end portion of the rear wall 3F.

When the developer reservoir is closed as shown in FIG. 1, the stopper member 3G can be moved through the small opening 1E in the reservoir body 1 and entered easily into the loop of the wound portion of the flexible seal member 2. Even if the flexible seal member 2 with the loop is pulled, the pulling force is blocked by the stopper member 3G, and the sealed opening of the reservoir body 1 cannot easily be opened.

The front side of the sliding cover 3 is open, and a projection 3H is provided on the bottom surface thereof. This projection 3H is formed so that it can be inserted into and withdrawn from a bore 12A in a slide cover 12 with which an opening at the upper portion of a developer resupply unit 10 in a developing device, which will be described later, is opened and closed.

How to assemble the developer reservoir according to the present invention will now be described in order of the assembling steps.

(1) The flexible seal member 2 is placed on the sealing surface 1A at the bottom opening of the reservoir body 1, and then thermally fused (heat-sealed) thereto.

(2) The portions of the flexible seal member 2 and the small projections 1C are spot-fused thermally.

(3) The non-fused extension of the flexible seal member 2 is inserted into the recess 1D to form a loop thereof, and this portion of the seal member 2 and the small projections 1F are thermally fused so as to fix this loop.

(4) The seal member 2 is folded back at the loop mentioned above, and then drawn along the lower surface of the portion thereof which is fused to the sealing surface 1A, and the portion of the seal member 2 which is close to the terminal end thereof is passed through the slit 1M and drawn to the outside.

(5) The retainer member 5 on which the cleaning pad 4 is pasted with a double side tape is inserted into the slit 1M from the lower side thereof toward the outer side thereof, so that the stopper portion 5B engages the lower end of the slit 1M, whereby the outward movement of the retainer member 5 is stopped. While the retainer member 5 is passed through the slit 1M, the former press-contacts both of the side surfaces of the latter and is elastically compressed. After the retainer member 5 has passed through the slit 1M, the former elastically expands and engages the locking portion 1T, so that the retainer member 5 is held in a non-backwardly-movable state. When the retainer member 5 is in this condition, the seal member 2 is sandwiched under pressure between one wall surface of the slit 1M and the cleaning pad 4 as shown in FIG. 1.

(6) The terminal end portion of the seal member 2 may be fixed tentatively to a wall outside the reservoir body 1 by using a tape.

(7) The sliding cover 3 is then fitted to the bottom portion of the reservoir body 1 so as to move to the closing position. Namely, the slide rails 3B, 3C of the sliding cover 3 are fitted to the slide rails 1H, 1J of the reservoir body 1 (refer to FIG. 3).

(8) When the sliding cover 3 is then moved into the reservoir body 1, the stopper member 3G of the sliding cover 3 enters the loop of the seal member 2, which is formed in the recess 1D in the reservoir body 1 (refer to FIG. 1).

(9) When the sliding cover 3 is then further pushed into the reservoir body 1, the click projections 3D, 3E of the sliding cover 3 engage the click grooves 1K, 1L in the bottom portion of the reservoir body 1, so that the sliding cover 3 stops and closes. During this operation for closing the sliding cover 3, the front end of the flat portion 3A thereof engages the elastic member 6 and close the reservoir body 1. When the vertical wall 3F of the sliding cover 3 engages the side wall 1Q of the reservoir body 1 to close the reservoir body 1, the side surface of the projection 3H of the sliding cover 3 press-contacts the elastic member 7 bonded to the side wall 1P of the reservoir body 1 to close the developer reservoir. FIG. 2 shows the developer reservoir thus closed.

(10) The developer reservoir is then placed on a table of a developer filling machine with the right side wall 1S of the reservoir body 1 positioned horizontally, and a predetermined quantity of developer D is injected from the upwardly directed opening 1R into the interior of the reservoir body 1.

(11) The developer reservoir is placed on a table of a plugging machine with the developer reservoir body left in the above-mentioned posture, and the cap member 8 is inserted into the opening 1R. When the opening 1R is then sealed under pressure by the plugging machine, a projection 8A of the cap member 8 engages the inner end surface of the opening 1R, so that the cap member 8 does not come off.

After these assembling steps have been carried out, the developer-containing developer reservoir becomes ready to be operated.

Figure 9:
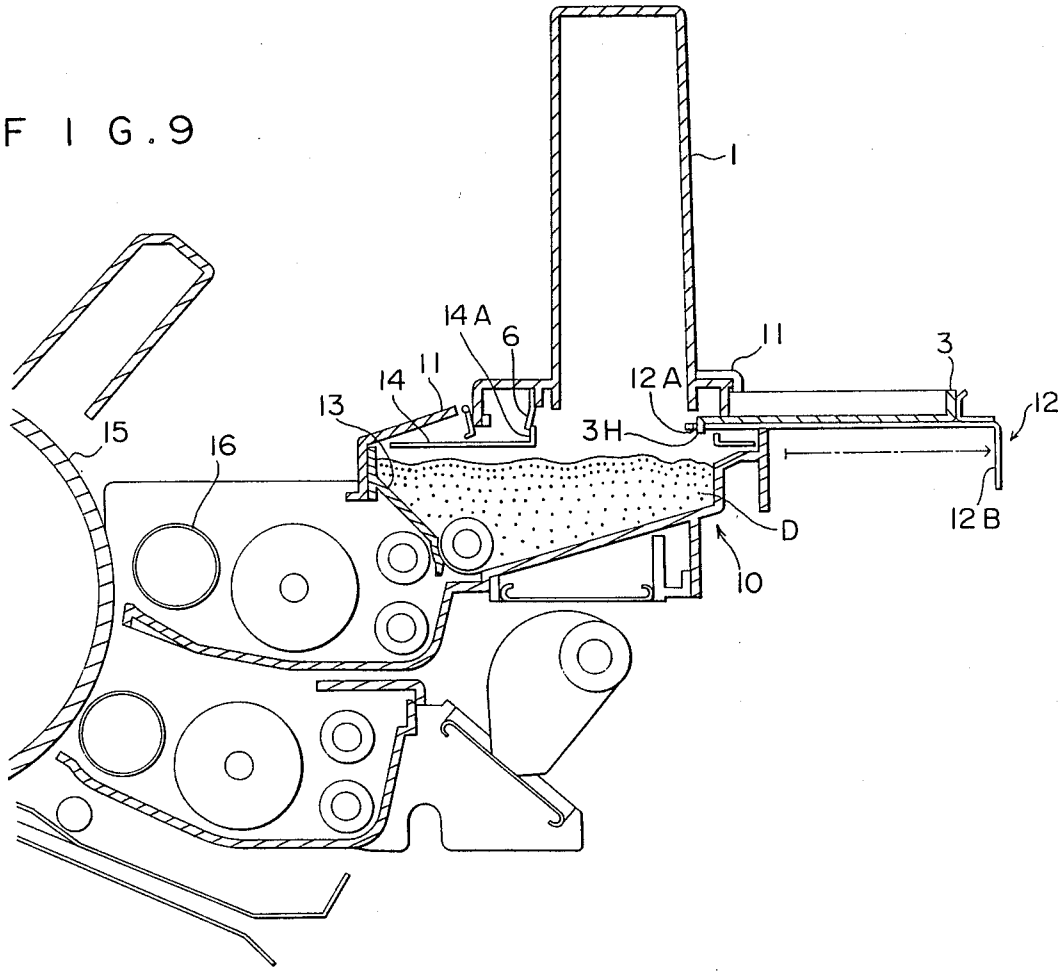
FIG. 9 is a sectional view of the developer reservoir connected to a developer resupplying unit of an electrophotographic reproducing machine in a state of a developer resupplying operation.

An operation for joining the developer reservoir according to the present invention to a developer resupplying unit in a developing device and supplying the developer to the developing device will now be described with reference to FIG. 9. FIG. 9 is a sectional view of the developer reservoir according to the present invention connected to a developer resupplying unit in an electrophotographic reproducing machine and carrying out a developer resupplying operation.

(A) First, the developer reservoir assembled as mentioned above and shown in FIGS. 1 and 2 is joined fixedly to a detachable setting means 11 at the upper portion of the developer resupplying unit 10. During this operation, the projection 3H of the sliding cover 3 fits in the bore 12A provided in one end portion of the movable cover 12 placed over an opening of the detachable setting means 11, and the sliding cover 3 and setting means 11 is thereby unitarily combined.

(B) When the finger is put on a handle 12B of the movable cover 12 to pull the same to right, the sliding cover 3 unitarily combined with the movable cover 12 is also moved to right, so that the cover is opened. During this time, the stopper member 3G of the sliding cover 3 escapes from the loop of the seal member 2.

(C) While the cover is thus opened, the elastic member 6 of the developer reservoir is engaged with a vertical wall 14A of an opening of a fixed screen plate 14 provided below the detachable setting means 11 and at the upper portion of a hopper 13, to prevent the floating developer D from being deposited on the detachable means 11.

(D) The tape with which the exposed terminal end portion of the seal member 2 is fixed to the reservoir body 1 is then removed, and this terminal end portion is held by the hand and pulled out with a considerably large force. Consequently, the portions of the loop of the seal member 2 which are spot-bonded to the top portions of the small projections 1F in the recess 1D are separated first, and then the portions of the seal member 2 which are spot-fused to the small projections 1C provided close to the bottom opening. When the seal member 2 is further pulled out, it is separated from the left end 1AA of the sealed surface 1A and along a left inclined surface 1AB in order, and then from parallel surfaces 1AC. Thus, the seal member 2 is separated from the whole of the sealed surface 1A, and the bottom opening of the reservoir body 1 is fully opened. During this reservoir body-opening operation, the developer D held in the reservoir body 1 falls as the bottom thereof is opened, and the whole quantity of the developer is supplied to the interior of the hopper 13. FIG. 9 shows the completion of such a developer supplying operation.

While the seal member 2 is drawn out as mentioned above, it is pressed and rubbed by the cleaning pad 4, the developer deposited on the seal member 2 is rubbed off thereby, so that a wiped clean seal member 2 is recovered at the outer side of the reservoir body 1.

(E) When the handle 12B of the movable cover 12 is pushed back toward the hopper 13 and set in the stopping position after the supplying of the developer has been completed, the hopper 13 is closed and the sliding cover 3 is also closed at the same time. When the cover is thus closed, the left side on which the projection 3H of the sliding cover 3 is provided press-contacts the elastic member 7 to completely seal the reservoir body 1. Accordingly, the developer remaining in the reservoir body 1 does not in any case leak to the outside.

(F) The developer reservoir thus closed is then removed from the detachable setting means 11 and discarded.

The length of the opening on the inner side of the sealing surface 1A of the bottom portion of the developer reservoir according to the present invention is set substantially equal to the overall length of the photosensitive drum 15 and that of the developing sleeve 16. Therefore, the developer falling from the bottom opening of the reservoir body is supplied to the developing device uniformly over the whole length of the developing sleeve, so that a toner image of a uniform density can be formed.

The electrostatically-charged image developer reservoir described above can be used as any of a reservoir for a one-component developer using a magnetic toner, a reservoir for a two-component developer, and a toner resupply reservoir for a two-component developer using a toner and a carrier. The present invention is not limited to any of these developer reservoirs.

The present invention can provide an excellent developer reservoir capable of being handled easily, preventing the outflow and scattering of the developer, and supplying the developer uniformly over the whole length of the developing sleeve. Since the bottom opening of the developer reservoir and the seal member are protected by a hard sliding cover, the developer reservoir is safe against an impact force, a large pressing force and a falling object. The developer deposited on the bottom portion of the developer reservoir after a developer supplying operation has been completed does not leak to the outside owing to the sliding cover and doubly provided elastic members by which the developer reserve is sealed. Accordingly, the contamination of the operator's hands and clothes and electrostatic reproducing machine can be prevented very effectively even when the developer reservoir is removed from the developing device and discarded.

What is claimed is:

1. A developer reservoir comprising a reservoir body containing a developer, a flexible seal member releasably bonded to a circumferential surface of an opening in a bottom portion of the reservoir body for sealing said opening, a portion extending from said bonded seal member and folded back to form a loop, a tip end of said extended portion of said seal member positioned outside said reservoir body, a stop member adapted for movement between a first position wherein said member is in said loop and a second position in which said member is outside said loop, the separation of the seal member being prevented when said stop member is in said first position and permitted when said stop member is in said second position, a sliding cover below said seal member and slidably mounted on said reservoir body, said sliding cover adapted to be drawn in a right angle direction to a separating direction of said seal member when said stop member is in said second position, thereby enabling said seal member to be separated and, when said seal member is drawn out, said opening is opened to permit said developer in said reservoir body to be discharged.

2. The reservoir of claim 1 wherein said stop member is mounted on said sliding cover.

3. The reservoir of claim 1 wherein said extended position is spot-bonded to a plurality of points on said bottom portion, whereby said seal member is separated first from the spot-bonded portions of said bottom portion and then from said circumferential surface when a substantial pulling out force is applied to said seal member.

4. The reservoir of claim 1 comprising an elastic member having one end fixed near said opening of said reservoir body and another end sliding and resilient in contact with an inner surface of said sliding cover.

5. A developer resupplying apparatus having a movable cover for attaching detachably to a developer resupplying unit of a developing device a developer reservoir characterized by comprising a reservoir body containing a developer therein, a flexible seal member separably bonded to the circumferential surface of an opening in a bottom portion of the reservoir body for sealing the same opening, and a sliding cover provided at a position below the seal member slidably on the reservoir body for opening and closing said opening of the reservoir body, wherein when said developer reservoir is attached to said developer resupplying unit an engaging portion of the sliding cover of the developer reservoir engages an engaging portion of the developer resupplying unit and when said movable cover is moved an opening of said developer resupplying unit is opened and closed and at the same time said sliding cover is opened and closed.

* * * * *